US010222166B1

(12) United States Patent
Sheridan

(10) Patent No.: US 10,222,166 B1
(45) Date of Patent: Mar. 5, 2019

(54) BREAKDOWN ADAPTER

(71) Applicant: Bradley Sheridan, Glendora, CA (US)

(72) Inventor: Bradley Sheridan, Glendora, CA (US)

( * ) Notice: Subject to any disclaimer, the term of this patent is extended or adjusted under 35 U.S.C. 154(b) by 437 days.

(21) Appl. No.: 14/823,810

(22) Filed: Aug. 11, 2015

Related U.S. Application Data

(60) Provisional application No. 62/036,990, filed on Aug. 13, 2014.

(51) Int. Cl.

| | |
|---|---|
| ***F41A 21/48*** | (2006.01) |
| ***F41A 3/66*** | (2006.01) |
| ***F41G 11/00*** | (2006.01) |
| ***F41C 23/16*** | (2006.01) |

(52) U.S. Cl.
CPC ..... *F41A 21/48* (2013.01); *F41A 3/66* (2013.01); *F41C 23/16* (2013.01); *F41G 11/003* (2013.01)

(58) Field of Classification Search
CPC .... F41C 7/11; F41A 3/66; F41A 21/48; F41A 21/484; F41A 21/485; F41A 21/481; F41A 3/30; F41G 11/003
USPC ..... 42/75.02, 124, 111, 146, 71.01, 75.01
See application file for complete search history.

(56) References Cited

U.S. PATENT DOCUMENTS 450,448 A * 4/1891 Cilley ..... F41A 21/482 42/75.02
2,362,613 A * 11/1944 Browning ..... F41A 21/484 42/75.02
2,611,297 A * 9/1952 Simpson ..... F41A 21/484 42/75.02
3,252,237 A * 5/1966 Korzeniewski ..... F41A 21/484 42/106
3,538,810 A * 11/1970 Maillard ..... F41A 3/66 42/75.02
3,731,418 A * 5/1973 Birkenhagen ..... F41A 21/481 42/75.02
3,961,436 A * 6/1976 Hagen ..... F41A 5/18 42/75.02
5,155,284 A * 10/1992 Flashkes ..... F41A 21/484 42/75.02
5,410,834 A * 5/1995 Benton ..... F41A 21/482 42/75.02
5,590,484 A * 1/1997 Mooney ..... F41G 1/16 42/111
5,669,169 A * 9/1997 Schmitter ..... F41A 3/66 42/71.02
6,073,895 A * 6/2000 Isbell ..... F41G 1/38 248/201
6,836,990 B2 * 1/2005 Shiloni ..... F41G 11/003 42/75.02
7,523,580 B1 * 4/2009 Tankersley ..... F41C 23/16 42/71.01
7,726,060 B1 * 6/2010 Jones ..... F41A 3/66 42/75.02

(Continued)

*Primary Examiner* — Joshua E Freeman
*Assistant Examiner* — Bridget A Cochran
(74) *Attorney, Agent, or Firm* — The Law Office of Austin Bonderer PC; Austin Bonderer

(57) ABSTRACT

A breakdown adapter having a retainer. The retainer has a left retainer and a right retainer. The left retainer has a left engaging means and a left retaining means. The right retainer has a right engaging means and a right retaining means. The left engaging means has two or more left protrusions. The right engaging means has two or more right protrusions. The fastener is configured to secure left engaging means to the right engaging means.

15 Claims, 9 Drawing Sheets

(56) References Cited

U.S. PATENT DOCUMENTS 7,810,271 B2 * 10/2010 Patel ..... F41A 11/02 42/75.03
7,823,315 B2 * 11/2010 Webber ..... F41A 11/02 42/71.01
8,136,284 B2 * 3/2012 Moody ..... F41A 23/08 42/71.01
8,336,244 B2 * 12/2012 Peterson ..... F41G 11/001 42/124
8,458,946 B1 * 6/2013 Pintsch ..... F41A 23/08 42/90
8,528,246 B2 * 9/2013 Telles ..... F41C 23/16 42/71.01
8,726,558 B1 * 5/2014 Nason ..... F41C 23/16 42/71.01
8,819,982 B2 * 9/2014 Battaglia ..... F41A 3/64 42/75.03
2002/0116857 A1 * 8/2002 Wonisch ..... F41A 3/64 42/75.02
2003/0150151 A1 * 8/2003 Orth ..... F41A 21/484 42/75.02
2004/0103577 A1 * 6/2004 Compton ..... F41C 27/00 42/85
2005/0188590 A1 * 9/2005 Baber ..... F41A 21/12 42/75.02
2006/0156609 A1 * 7/2006 Kim ..... F41G 11/003 42/124
2006/0260169 A1 * 11/2006 Samson ..... F41C 23/16 42/72
2007/0199225 A1 * 8/2007 Haugen ..... F41G 11/003 42/85
2007/0199435 A1 * 8/2007 Hochstrate ..... F41A 3/66 89/191.02
2008/0155876 A1 * 7/2008 Matthews ..... F41G 11/003 42/124
2010/0154280 A1 * 6/2010 LaFrance ..... F41G 11/001 42/124
2010/0229450 A1 * 9/2010 Becker ..... F41C 23/14 42/90
2012/0198990 A1 * 8/2012 Brittin ..... F41A 5/26 89/191.01
2013/0263732 A1 * 10/2013 Kucynko ..... F41C 23/16 89/191.01
2014/0059908 A1 * 3/2014 Dextraze ..... F41G 11/002 42/1.06
2014/0130390 A1 * 5/2014 Geissele ..... F41C 23/16 42/71.01
2016/0161201 A1 * 6/2016 Langevin ..... F41A 3/66 42/75.02

* cited by examiner

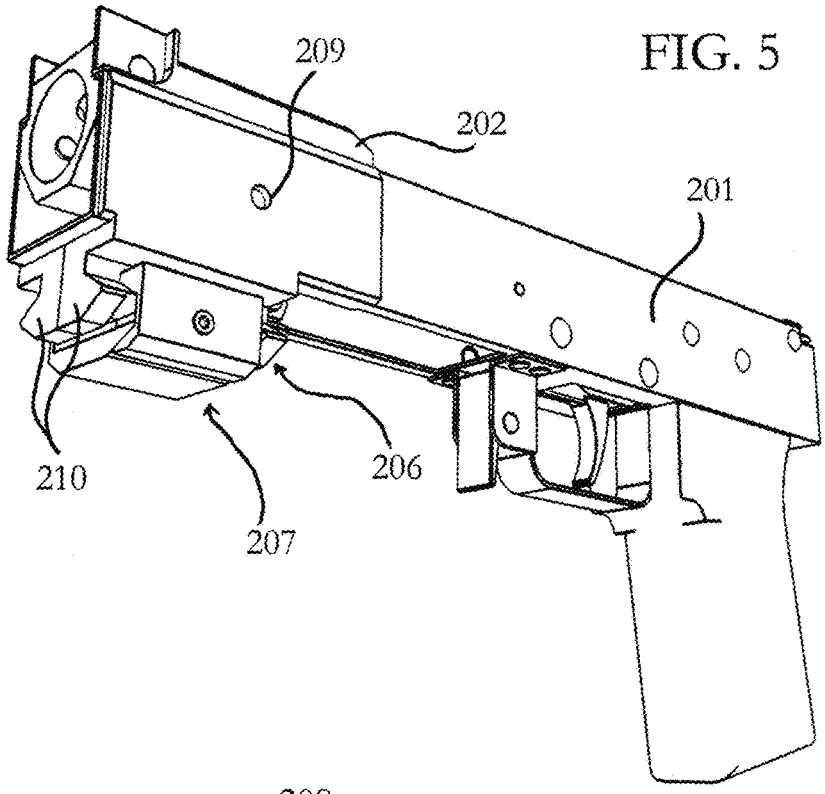
FIG. 5
FIG. 6
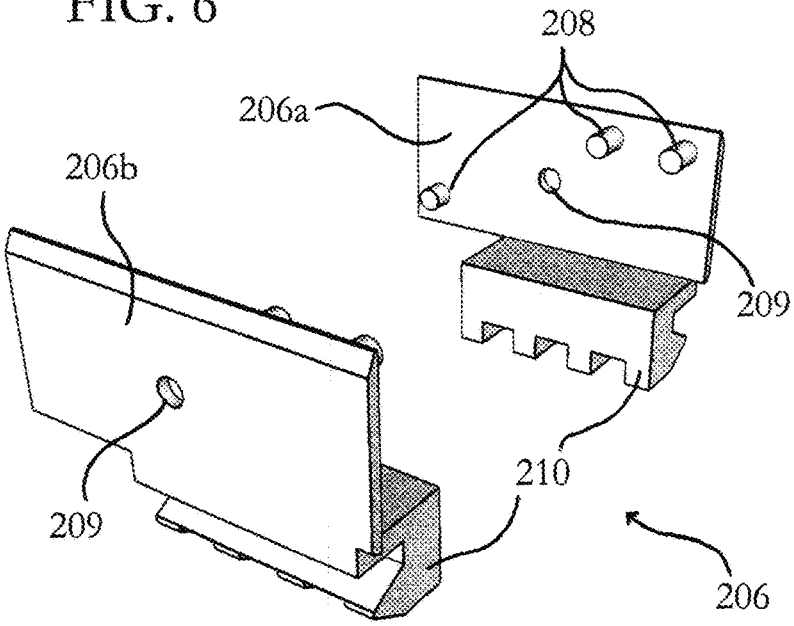

BREAKDOWN ADAPTER

TECHNICAL FIELD

The field of the present invention relates to firearm assembly. Some embodiments are used for removably securing the stock and/or front trunnion to the receiver of a firearm.

BACKGROUND OF THE INVENTION

One of the most popular weapons platform is the AK-47. While many variations of AK-47, AK platforms, and other firearm platforms, parts and build kits exist, they share a common inadequacy. Current assembly methods require rivets in order to secure the front trunnion to the receiver of the rifle. While this creates a sturdy union between the front trunnion and receiver it is difficult and time consuming to install the rivets. Furthermore, once installed, the rivets must be ground down and/or drilled out in order to remove the front trunnion making the installation essentially permanent. Furthermore, current rivet assemblies and methods do not allow for the repeated and efficient disassembly and reassembly of the AK-47 rifle and other firearm platforms.

BRIEF SUMMARY OF THE INVENTION

The present disclosure is directed to an apparatus used in the assembly and disassembly of firearms, particularly in securing the front trunnion within the receiver. The breakdown adapter is designed to install easily, allow for the rifle to be quickly and repeatedly disassembled and reassembled, and may provide an additional location on the firearm to attach accessories, such as a vertical fore grip or flashlight.

One main feature of the breakdown adapter is that it installs easily during assembly of the firearm. Unlike traditional rivet assemblies described above, the breakdown adapter does not require any additional riveting tools, skills or time. There are two retainers to replace the six rivets, typically used in securing the front trunnion to the receiver. There is one retainer for the left side and one for the right. Protruding from each retainer are three protrusions, which are aligned with holes in the receiver where the rivets would have been installed. It is understood that the number and locations of protrusions and/or the rivets can vary.

After properly positioning the front trunnion within the receiver channel, the corresponding retainers are attached to their respective sides by easily inserting the protrusions of the retaining retainers into the holes where the rivets would be inserted. Once attached, retainers will secure the front trunnion, and/or the stock, and prevent it from sliding out of the receiver channel.

In some embodiments, the lower part of each retaining retainer includes half a picatinny rail and/or an accessory securing means. When the left and right retainer retainers, with picatinny halves, are installed on the receiver, the two half picatinny rails abut one another and form a full picatinny rail. This rail can serve a dual purpose. First the rail can allow for the two retainers to be secured together. A basic clamp or screw fastener can be used on the rail and will compress the two retaining retainers around the receiver thus preventing the retaining retainers from coming off during operation of the rifle. Second, the picatinny rail can provides and additional mounting surface for a vertical fore grip, flashlight or other accessory.

In some embodiments, the retaining retainers cannot be removed by hand and threaded holes into which a screw can be threaded are provided. The pressure from the screw bottoming out against the receiver wall will separate the retaining retainer from the receiver. After the retainers have been removed, the front trunnion, including the upper and lower fore grips, and barrel assembly, will slide out of the receiver channel leaving two smaller sections. The rifle can then be stored or transported and reassembled as needed by sliding the sections back together and reattaching the retainers.

The foregoing is intended to provide a broad description of the present invention in order to demonstrate its contributions to the art and better understand the descriptions to follow. These and other features of the present invention will be readily apparent to persons of ordinary skill in the art upon reading the entirety of this disclosure.

BRIEF DESCRIPTION OF THE SEVERAL VIEWS OF THE DRAWINGS

Many aspects of the embodiments can be better understood with parameters to the following drawings. The components in the drawings are not necessarily drawn to scale, the emphasis instead being placed upon clearly illustrating the principles of the embodiments. Moreover, in the drawings, like reference numerals designate corresponding parts throughout the several views.

FIG. 5 is an isolated view of a receiver and trunnion assembled with breakdown adapter according to an embodiment.

FIG. 6 is an isolated view of breakdown adapter according to an embodiment.

DETAILED DESCRIPTION OF THE INVENTION

Figure 1:
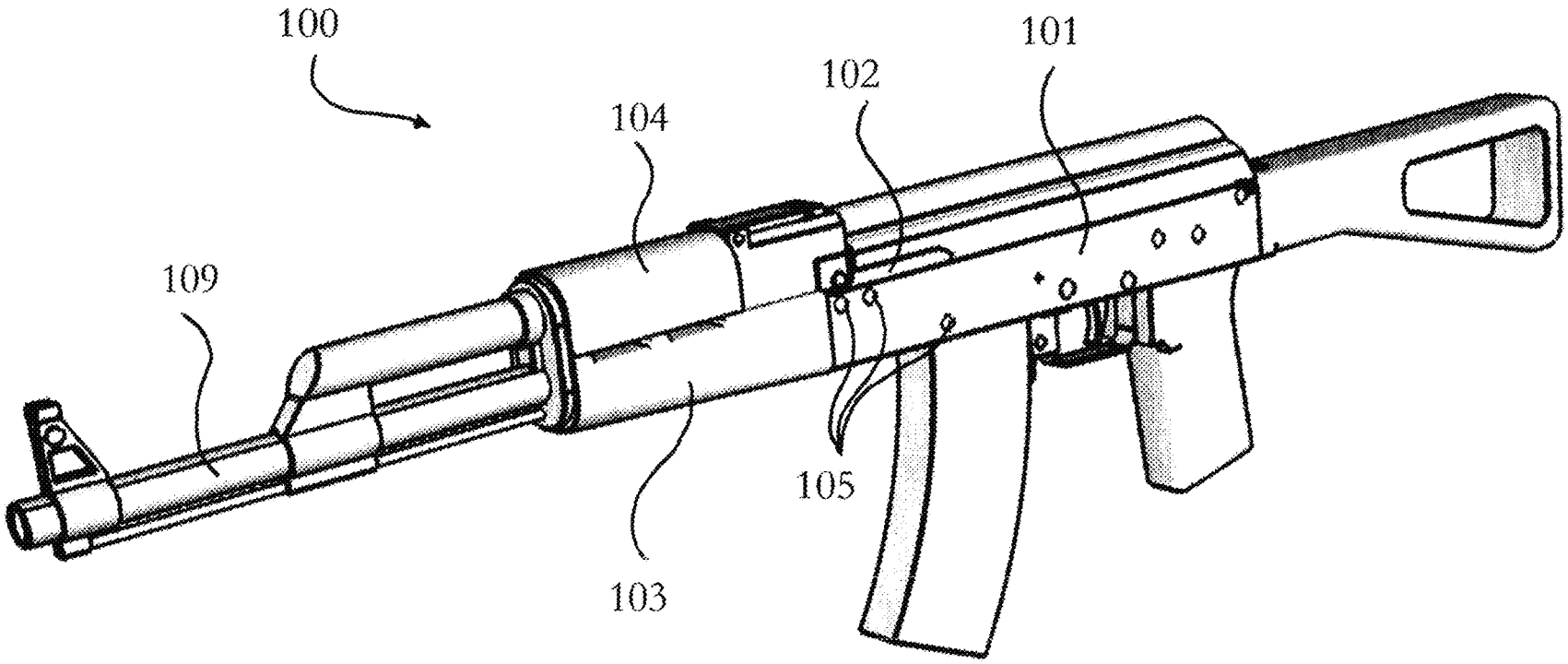
FIG. 1 is a perspective view of an AK-47 assembled with traditional rivet assembly of the prior art.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

The present disclosure describes an apparatus for the assembly and breakdown of an AK-47 rifle. However it is understood that the description in relation to the AK-47 platform is for illustrative purposes only and is not meant to limit the scope of the disclosure. Many other platforms include, but are not limited to, AK-74, AKM, AKS, AMD, M70, M85, M92, RPK and PSL. It is also understood that the design is not limited to derivatives of the AK platform.

Figure 2:
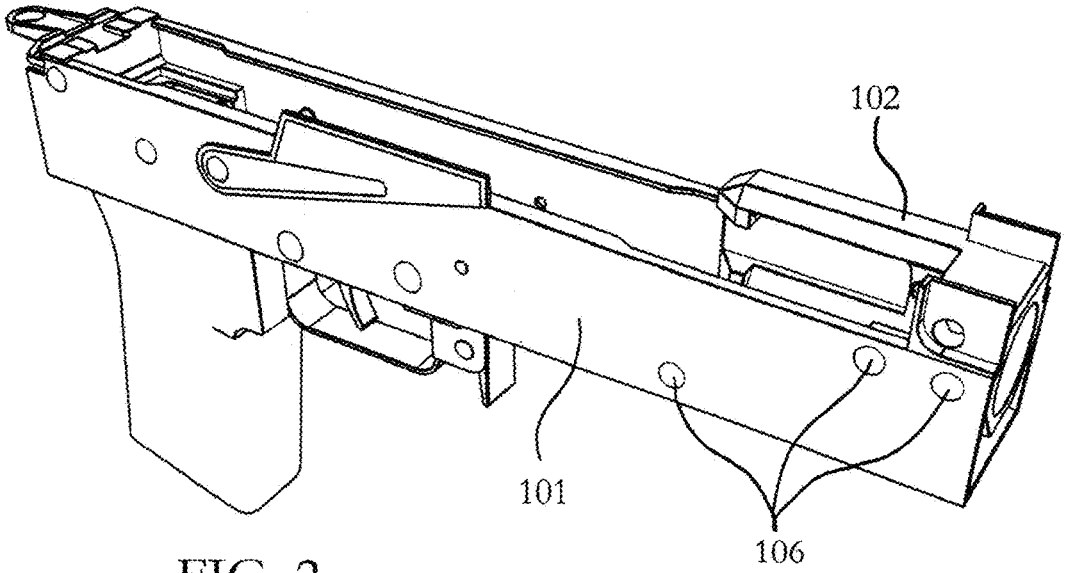
FIG. 2 is an isolated view of a receiver and front trunnion of an AK-47 with traditional rivet assembly of the prior art.
Figure 3:
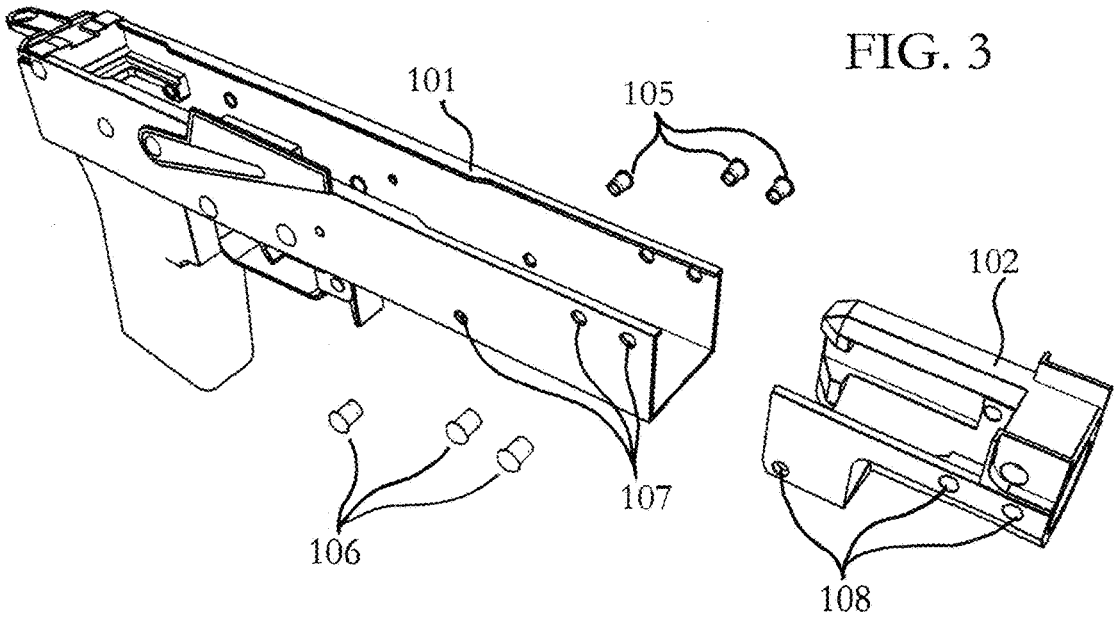
FIG. 3 is an exploded view of a receiver and front trunnion of an AK-47 with traditional rivet assembly of the prior art.

Traditional assembly of the AK-47 rifle 100, as shown in FIGS. 1 through 3, comprises the use of rivets 105 and 106 to join the front trunnion 102 to receiver 101. Rivets 105 and 106 are designed for permanent installation so that receiver 101 and trunnion 102 cannot be separated from one another without grinding down or drilling out rivets 105 and 106.

The fully assembled AK-47 rifle 100 assembled with rivets 105 and 106, as shown in FIG. 1 comprises several main components. The front sub-assembly of AK-47 rifle 100 generally comprises front trunnion 102, a lower fore grip 103, an upper fore grip 104, and a barrel assembly 109. In the traditionally assembly of an AK-47 rifle 100, the front trunnion 102 is first installed into receiver 101 and permanently secured with rivets 105 and 106. Once secured, barrel assembly 109, lower fore grip 103, and upper fore grip 104 are attached to trunnion 102.

FIGS. 2 and 3 show an isolated and an exploded view of front trunnion 102 secured to receiver 101 in a traditional assembly. For ease of explanation, FIG. 2 only shows the right side views for receiver holes 107; while FIG. 3 only shows the right side view of the mounting holes 108. Each of these components is present and mirrored on the opposite side of receiver 101 and trunnion 102, respectively. During assembly, front trunnion 102 slides into the u-shaped channel of receiver 101. Front trunnion 102 is generally a standard design having three mounting holes 108 on each side of trunnion 102. Mounting holes 108 are positioned in a standard pattern, which correspond with receiver holes 107. Receiver holes 107 are also positioned in a standard pattern. It is understood that, in some embodiments, the receiver holes 107 on each side need not mirror each other. In some embodiments, the receiver holes 107 can be located in many different locations.

After trunnion 102 is properly positioned within receiver 101 and mounting holes 108 are aligned with corresponding receivers holes 107, rivets 106 are inserted through receiver holes 107 and mounting holes 108, as shown in FIG. 2. Rivets 106 are then riveted in place thereby securing trunnion 102 into receiver 101. Rivets 105 are likewise inserted and riveted in place on the opposite side of the receiver 101. Once rivets 105 and 106 have been riveted in place, trunnion 102 cannot be removed from receiver 101 without destroying rivets 105 and 106.

Figure 4:
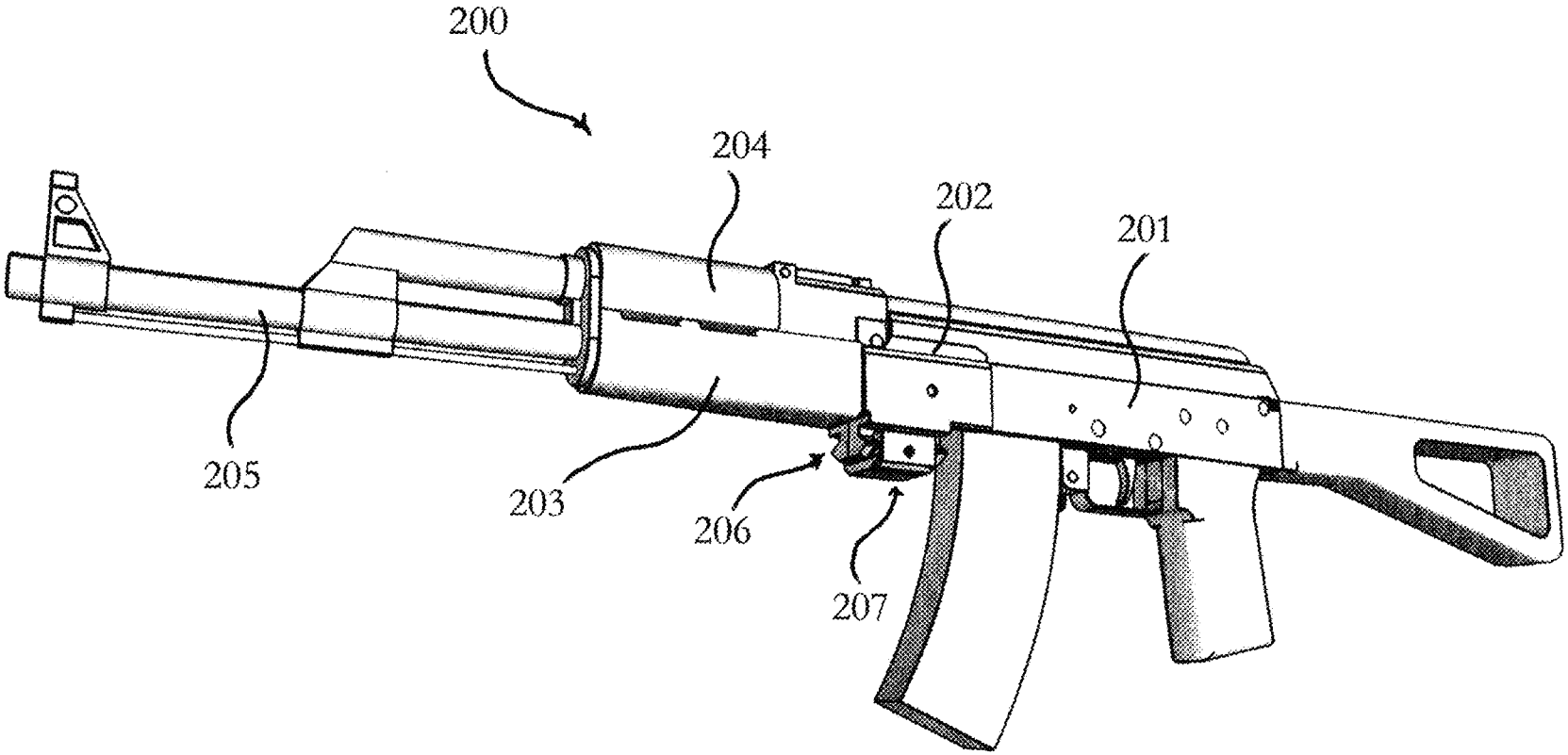
FIG. 4 is a perspective view of an AK-47 assembled with breakdown adapter according to an embodiment.

As can be seen in FIG. 4, an embodiment of the breakdown adapter 206 is used in to secure the trunnion 102 within the receiver 101. Use of the breakdown adapter 206 provides for quicker and easier assembly than the traditional method, and allows for disassembly of AK-47 rifle 200 into two or three sub-assemblies for transport or storage. As shown in FIG. 4, AK-47 rifle 200 also comprises several main components including receiver 201, front trunnion 202, lower fore grip 203, upper fore grip 204 and barrel assembly 205. However, AK-47 rifle 200 does not have the rivets 105 or 106. Instead, rivets 105 and 106 are replaced by breakdown adapter 206.

Figure 7:
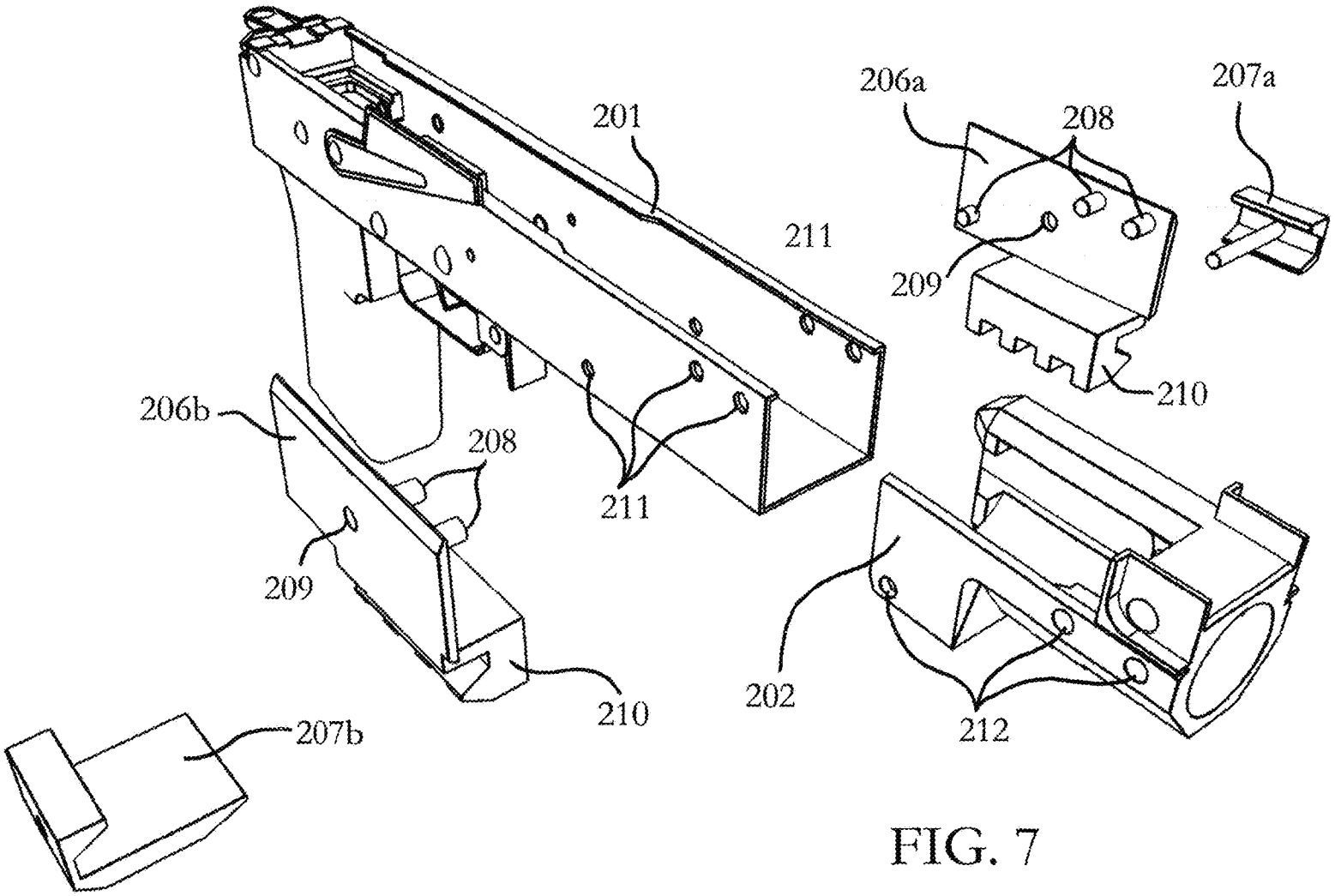
FIG. 7 is an exploded view of receiver and trunnion assembled with an AK-47 breakdown adapter according to an embodiment.

FIGS. 5 through 7 show isolated and exploded views of an embodiment of the receiver 201, trunnion 202, and breakdown adapter 206. As with traditional assembly, the trunnion 202 is positioned within the u-shaped channel of receiver 201. However, instead of using rivets to secure trunnion 202 in position, the breakdown adapter 206 is used.

The breakdown adapter is comprised of two pieces, a left retainer **206*a* and a right retainer 206*b*, as shown in FIG. 6. Left retainer 206*a* and right retainer 206*b* can, but need not, be mirror components of one another. Both the retainer 206*a* and right retainer 206*b* comprise an engaging means that comprises one or more protrusions 208. In one embodiment, each retainer 206*a* and 206*b* comprises three protrusions 208 protruding from its surface. Protrusions 208 are positioned to align with the pattern of receiver holes 211 on receiver 201. While three protrusions 208 on each retainer are shown, more or less protrusions 208 could be used and the position of each protrusion may vary depending on the number of receiver holes 211 and their position on receiver 201. The primary factor is that each protrusion 208 be aligned to match the corresponding receiver hole 211 for that particular receiver 201 and trunnion 202. Furthermore, the diameter of each protrusion 208 should be substantially the same size and/or diameter and provide a fit that will allow very little, if any, movement between the trunnion 202 and the receiver 201. In some embodiments, the protrusions 208** may have a tapered portion or may be tapered all the way from tip to bottom.

As shown in FIG. 7, front trunnion 202 comprises mounting holes 212, which align with corresponding receiver holes 211 when assembled. After front trunnion 202 has been properly positioned within receiver 201, retainers **206*a* and 206*b* are attached to their respective sides of the receiver 201. When retainers 206*a* and 206*b* are placed in their installed position and coupled together, protrusions 208 will pass through corresponding retainer holes 211 and mounting holes 212, thereby retaining trunnion 202 within receiver 201. Unlike traditional permanent assembly methods, trunnion 202 may still be removed from receiver 201 by first removing retainers 206***a* and 206*b*.

Also shown in FIGS. 5 through 7 are the securing rails 210 and the fastener 207. Securing rails 210 are each a component of retainers 206*a* and 206*b*. In some embodiments, when retainers 206*a* and 206*b* are placed in an installed position, securing rails 210 will abut one another to form a complete rail structure commonly known as a picatinny rail, MIL-STD-1913 rail, STANAG 2324 rail, or tactical rail. In some embodiments, the securing rails 210 can formed to resemble other shapes and structural formations. In some embodiments the securing means will be located on only one of the retainers 206*a* and 206*b*. In one embodiment, the securing rails 210 provide a point of attachment for fastener 207. In one embodiment, the fastener 207 comprises of fastening elements 207*a* and 207*b*, which attach the securing rails 210 and compress them together. A threaded member may extend from fastening element 207*b* that is able to thread into a portion and/or element of the second fastening element 207*a*. In other embodiments, the fastener 207 can be replaced by a multitude of accessories designed to attach to a picatinny rail.

Further shown in FIG. 7 is release hole 209. In one embodiment, release hole 209 is a threaded hole through the surface of each retainer 206*a* and 206*b*. Release hole 209 is threaded to accept a threaded element, such that when screwed through retainers 206*a* and 206*b*, in an installed position, will press against the surface of receiver 201 and cause retainers 206*a* and 206*b* to release from their installed position. This is helpful in removing the retainers 206*a* and 206*b* if they ever become difficult to remove.

Figure 8:
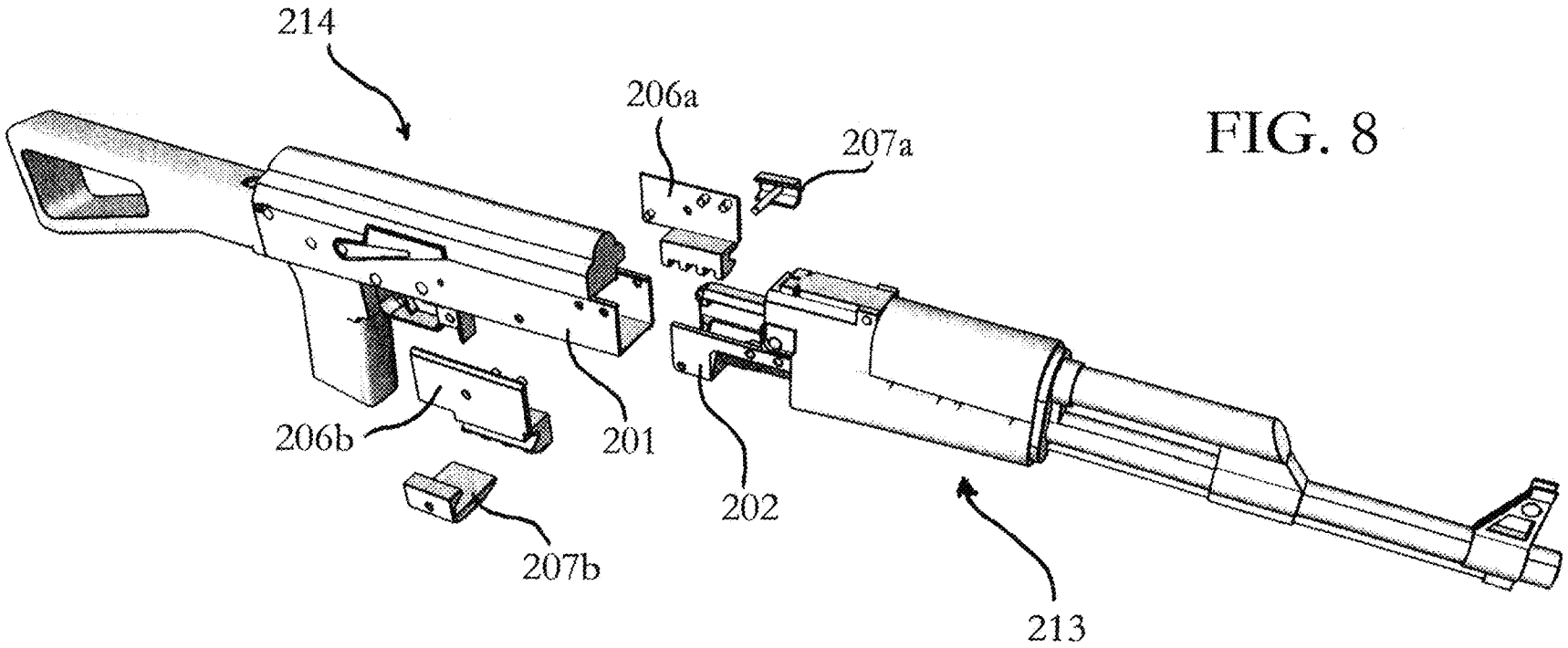
FIG. 8 is a perspective an AK-47 assembled with breakdown adapter broken down into a front subassembly and rear sub assembly according to an embodiment.

As shown in FIG. 8, the two sub-assemblies are shown with the breakdown adapter 206 in an exploded view. The rear sub-assembly 214 and the front sub-assembly 213 will engage each other and be secured by the retainers 206*a* and 206*b*, and the retainers 206*a* and 206*b* will be retained by the fastening elements 207*a* and 207*b*.

Figure 9:
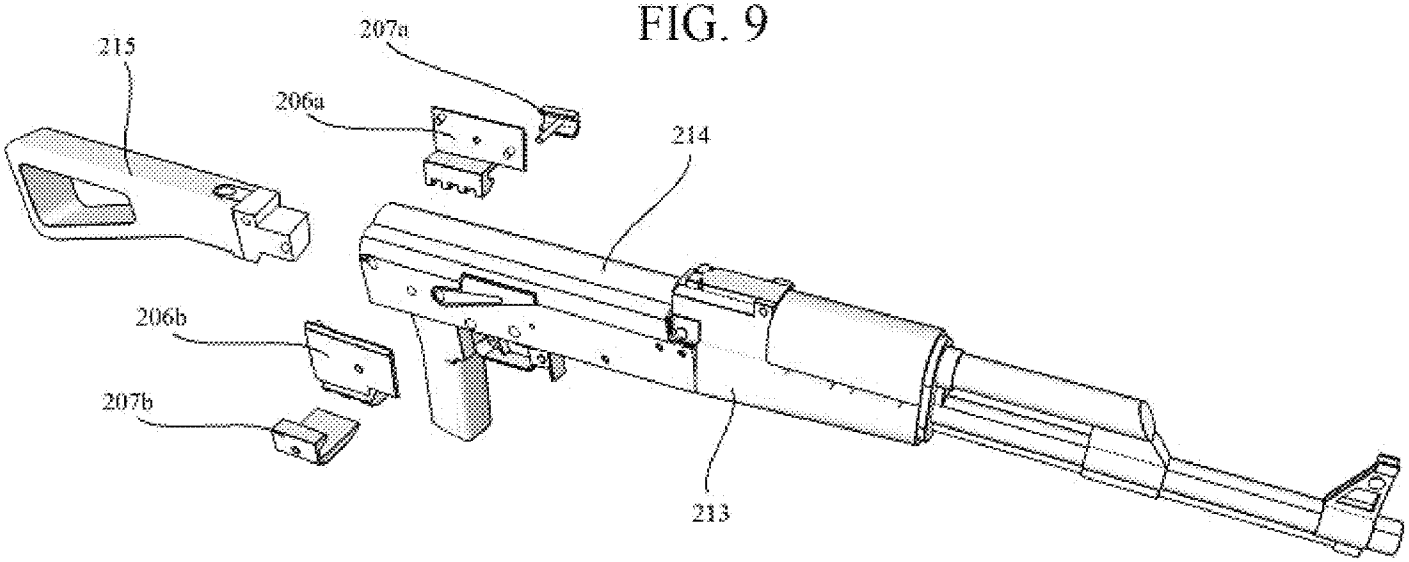
FIG. 9 shows an embodiment of the breakdown adapter that is used to secure a stock.
Figure 10:
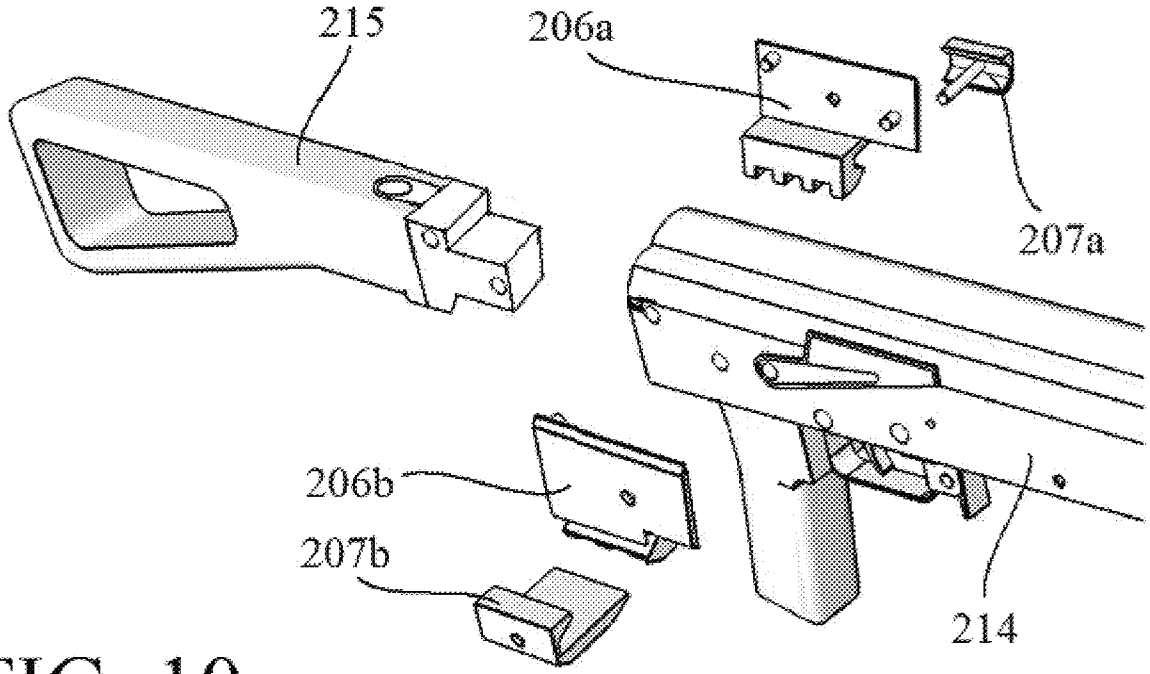
FIG. 10 shows an exploded view of an embodiment of the breakdown adapter that is used to secure a stock.

FIGS. 9 and 10 shows an embodiment where a fastener 207 is used to secure the stock 215 to the rear assembly 214. The stock 215 and the rear assembly 214 will engage each other and be secured by the retainers 206*a* and 206*b*, and the retainers 206*a* and 206*b* will be retained by the fastening elements 207*a* and 207*b*. In some embodiments, the fastener 207 that secures the stock to the rear assembly will not have securing rails 210.

Figure 11:
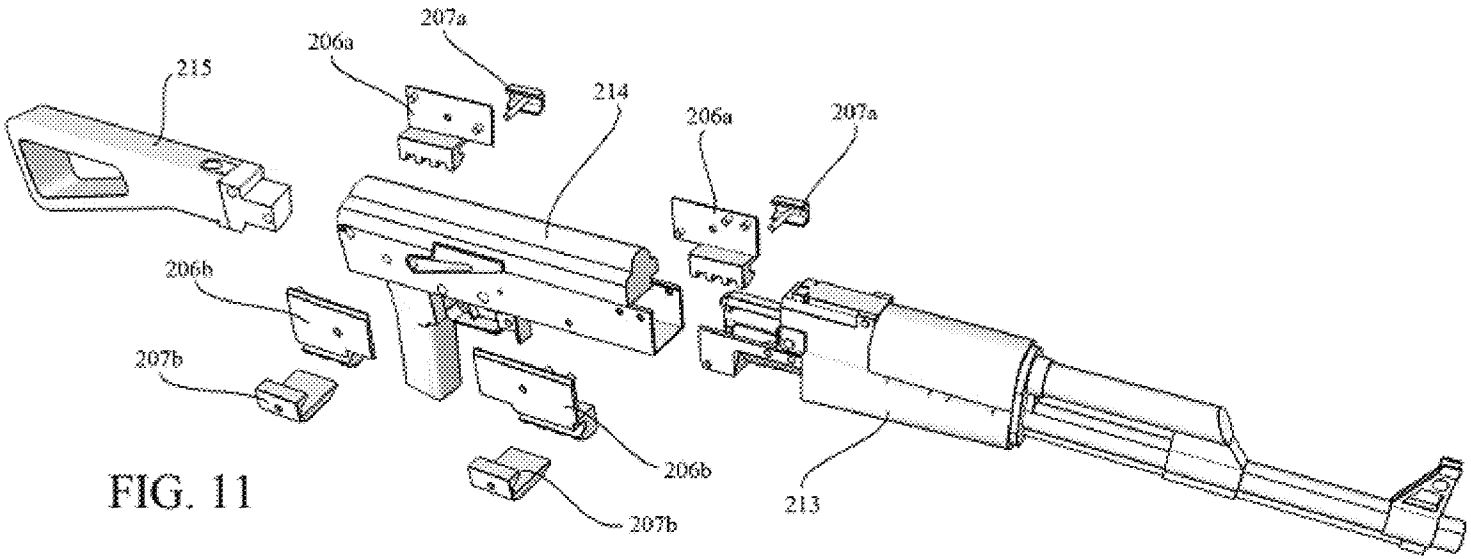
FIG. 11 shows an embodiment of the breakdown adapter that is used to attach a trunnion to the receiver and another embodiment of the breakdown adapter that is used to attach the stock to the receiver.

FIG. 11. Shows an embodiment employing two break down adapters 206. The rear sub-assembly 214 and the front sub-assembly 213 will engage each other and be secured by the retainers 206*a* and 206*b*. The stock 215 and the rear sub-assembly 214 will engage each other and be secured by the retainers 206*a* and 206*b*. All the retainers 206*a* and 206*b* will be retained by the fastening elements 207*a* and 207*b*.

Once retainers 206*a* and 206*b* have been released from their installed position, AK-47 rifle 200 may be separated into two sub assemblies by sliding front trunnion 202 out from the u-shaped channel of receiver 201 leaving a front sub-assembly 213 and a rear sub-assembly 214 as shown in FIG. 8. Sub-assemblies 213 and 214 can be easily and safely transported and/or stored and then reassembled as needed.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An apparatus comprising: a firearm comprising: a front assembly; a rear assembly; a retainer comprising a left retainer and a right retainer; the left retainer comprises a left engaging means and a left securing rail; and the right retainer comprises a right engaging means and a right securing rail; and a fastener; wherein the left engaging means comprises two or more left protrusions extending into both the front assembly and the rear assembly; the right engaging means comprises two or more right protrusions extending into both the front assembly and the rear assembly; the fastener secures the left retainer to the right retainer into an abutment with the front assembly and the rear assembly; and the retainer secures the front assembly to the rear assembly such that without the retainer the front assembly and the rear assembly would detach from each other.

2. The apparatus of claim 1, wherein a location of the two or more left protrusions correspond to the two or more right protrusions.

3. The apparatus of claim 1, wherein the left retainer, the right retainer, or both the left retainer and the right retainer define a release hole.

4. The apparatus of claim 3, wherein the release hole is threaded.

5. The apparatus of claim 1, wherein the fastener comprises of a first fastener and a second fastener, and a member; wherein the member extends in a direction that is perpendicular to the first fastener and the second fastener, and the first fastener engages the left retainer and the second fastener engages the right retainer.

6. The apparatus of claim 5, wherein the member, both the first fastener and the second fastener define a hole, and the member is in threaded engagement with both the first fastener and the second fastener.

7. The apparatus of claim 5, wherein the member is coupled to the first fastener.

8. The apparatus of claim 5, wherein the first fastener defines a first section that receives a portion of the left securing rail.

9. The apparatus of claim 8, wherein the second member defines a second section that receives a portion of the right securing rail.

10. The apparatus of claim 1, wherein the left securing rail and the right securing rail form a complete securing rail.

11. The apparatus of claim 10, wherein the complete securing rail is a picatinny rail.

12. The apparatus of claim 1, wherein the front assembly and the rear assembly define openings that correspond to and at least a portion has substantially the same the cross-section as the two or more left protrusions and the two or more right protrusions that are located within the openings.

13. The apparatus of claim 12, wherein the two or more left protrusions and the two or more right protrusions prevent substantial movement between the front assembly and the rear assembly.

14. The apparatus of claim 1, wherein the left retainer and the right retainer are secured together by the fastener.

15. The apparatus of claim 1, wherein the fastener abuts the left retainer and the right retainer.

* * * * *